United States Patent [19]

Bourget

[11] Patent Number: 4,497,474

[45] Date of Patent: Feb. 5, 1985

[54] APPARATUS FOR SEQUENTIALLY ANNEALING AND THEN HARDENING LONG METAL COMPONENTS MADE OF FINE OR SPECIAL STEEL

[75] Inventor: Jean-Claude Bourget, Issy les Moulineaux, France

[73] Assignee: Les Cables de Lyon, France

[21] Appl. No.: 559,839

[22] Filed: Dec. 9, 1983

Related U.S. Application Data

[63] Continuation of Ser. No. 362,324, Mar. 26, 1982, abandoned.

[30] Foreign Application Priority Data

Mar. 31, 1981 [FR] France ..... 81 06443

[51] Int. Cl.[3] ..... C21B 9/62; F27B 5/14

[52] U.S. Cl. ..... 266/81; 266/87; 266/108; 266/255

[58] Field of Search ..... 266/255, 108, 81, 85, 266/87, 88, 83

[56] References Cited

U.S. PATENT DOCUMENTS

| | | | |
|---|---|---|---|
| 2,983,497 | 5/1961 | Dailey, Jr. | 266/108 |
| 3,496,033 | 2/1970 | Gilbreath et al. | 266/87 |
| 3,593,972 | 7/1971 | Wehrle et al. | 266/108 |
| 3,904,444 | 9/1975 | Grange | 148/11.5 R |
| 3,950,192 | 4/1976 | Golland et al. | 148/16.5 |

FOREIGN PATENT DOCUMENTS

| | | |
|---|---|---|
| 814809 | 3/1937 | France . |
| 1467814 | 12/1966 | France . |
| 2227332 | 11/1974 | France . |

*Primary Examiner*—L. Dewayne Rutledge
*Assistant Examiner*—Christopher Brody
*Attorney, Agent, or Firm*—Sughrue, Mion, Zinn, Macpeak, and Seas

[57] ABSTRACT

A method of sequentially annealing and then hardening long metal components (1,2,3,4) made of fine or special steel with an austenitic structure, said method including at least one annealing operation by supplying heat from the outside in a reducing or neutral atmosphere and one quenching operation by contact with a flow of cooling fluid and an apparatus for putting said method into practice.

The flow rate and the temperature of the cooling fluid are adjusted so that the components undergo no transformation of their austenitic structure during hardening.

Application to annealing and hardening armoured electric components with conductor cores, inorganic insulant coatings and outer sheaths made of austenitic steel.

3 Claims, 1 Drawing Figure

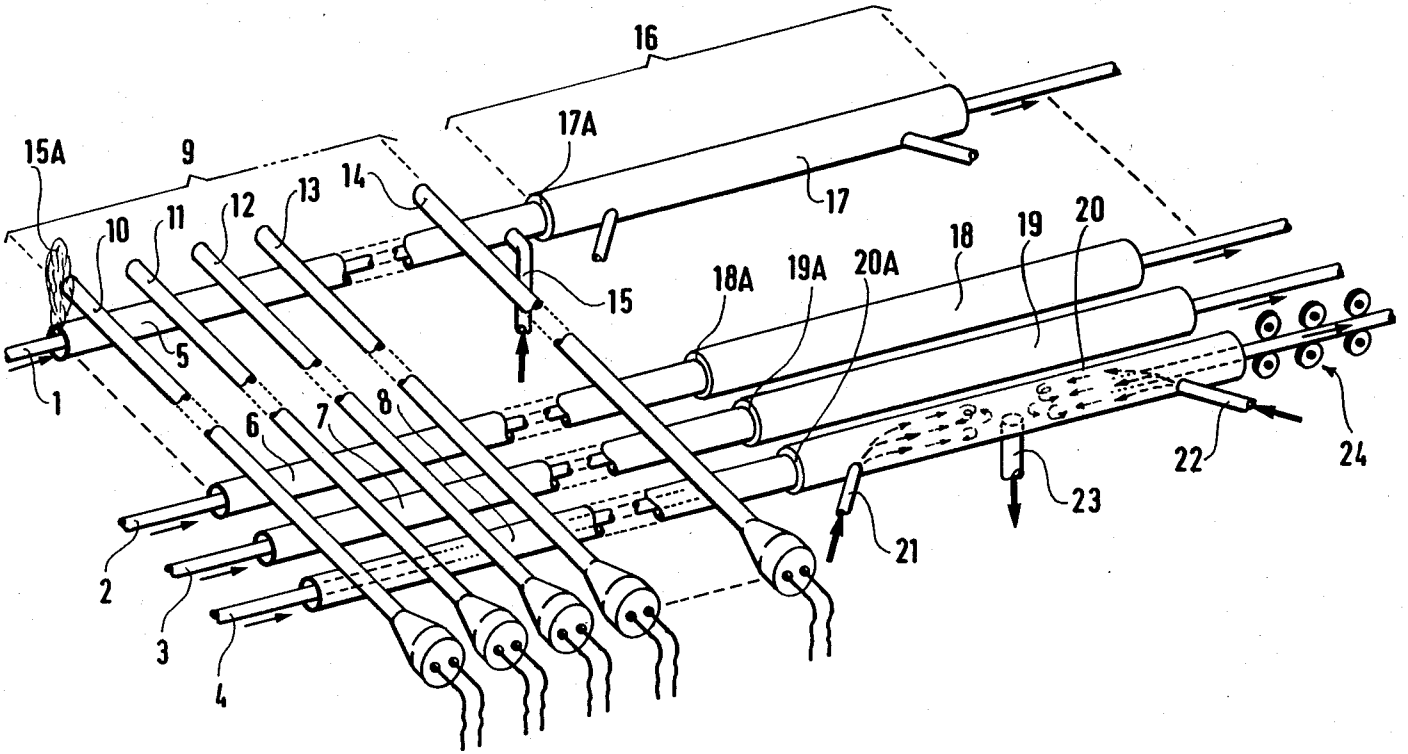
24
22
23
20
19
18
21
20A
19A
18A
17
16
15
17A
14
13
12
11
10
9
15A
8
7
6
5
1
2
3
4

APPARATUS FOR SEQUENTIALLY ANNEALING AND THEN HARDENING LONG METAL COMPONENTS MADE OF FINE OR SPECIAL STEEL

This application is a continuation of application Ser. No. 362,324, filed Mar. 26, 1982 abandoned.

The present invention relates to a method of sequentially annealing and then quenching long metal components made of fine or special steels with an autenitic structure said method including at least one annealing operation by supplying heat from the outside in a reducing or neutral atmosphere and one quenching operation by contact with a cooling fluid. It applies more particularly to successively annealing and quenching an armoured electrical component having at least a conductor core, a coating of mineral insulant and an outer sheath of fine or special steel with an austenitic structure.

It further relates to an apparatus for implementing said method.

BACKGROUND OF THE INVENTION

French Pat. No. 2,227,332 describes a method of heat treatment for armoured electric components with mineral isulants surrounded by stainless steel sheaths. The treatment is performed on a blank as it passes between two successive drawing operations, said method being divided into three consecutive steps: annealing the sheaths by high-frequency heating, annealing the cores of the cable in a thermally controlled chamber, heat being transmitted from the sheaths to the cores (together with an optional, additional supply of heat) and lastly, quenching the sheaths and the cores by a flow of water coming into contact with the sheaths.

While such a method which is very suitable for annealing and quenching long metal components made of steel with a well-defined austenitic structure, it is difficult to adapt to annealing and quenching metal components made of steel with slightly differing austenitic structures or of variable diameter or thickness. Sometimes, insufficient quenching of the steel is observed which leads to the appearance at some points of ferritic structures or to the appearance of unusual crystal enlargement which reduces the mechanical characteristics and can cause breakages during subsequent mechanical treatment.

Preferred implementations of the present invention mitigate these drawbacks by annealing and quenching such long metal components while making adjustments according to the quality of the steel, its diameter and its thickness, thereby avoiding the danger of either a ferritic structure or unusually large crystals appearing.

SUMMARY OF THE INVENTION

The present invention provides a method of sequentially annealing and then quenching long metal components made of fine or special steels with an austenitic structure, said method including at least one annealing operation by supplying heat from the outside in a reducing or neutral atmosphere and one quenching operation by contact with a flow of cooling fluid, wherein the flow rate and the temperature of the cooling fluid are adjusted so that the components undergo no transformation of their austenitic structure during quenching. Preferably, heat is supplied from the outside by Joule effect.

When the method is applied to annealing and quenching armoured electric components having at least one conductor core, mineral insulant coating and an outer sheath made of fine or special steel with an austenitic structure, it is preferable, for the sheath and the core to be annealed simultaneously.

Apparatus in accordance with the invention has a longitudinal muffle for each long metal component, at least one annealing furnace containing a reducing or neutral atmosphere and quenching apparatus by direct contact of cooling fluid and includes means for controlling the inlet temperature and the flow rate of the cooling fluid such that the austenitic structure of the long metal components does not undergo any transformation during quenching. Preferably, heat is supplied from the outside by Joule effect.

When successively annealing and quenching armoured electric components which have at least one conductor core, a mineral insulant coating and an outer sheath made of fine or special steel with an austenitic structure each, the apparatus preferably includes a single furnace with resistors on the outside of the muffles for simultaneously annealing the sheath and the core. Advantageously, said resistors are disposed perpendicularly to the direction in which the long metal components pass through the furnace and parallel to one another.

Particularly suitable resistors are made of silicon carbide rods.

BRIEF DESCRIPTION OF THE DRAWING

An apparatus for annealing and quenching armoured electric components during the manufacture of armoured resistance elements with compressed mineral insulants made of magnesia which withstands high operation temperatures of the type commercialized by Les Câbles des Lyon under the trade mark "Pyrotenax" is described hereinafter by way of example and with reference to the sole FIGURE of the accompanying drawing, which is a diagrammatic perspective view of such apparatus.

MORE DETAILED DESCRIPTION

In the perspective schematic FIGURE, the blanks of armoured electric components such as 1, 2, 3, 4 pulled by sets of rollers such as 24 enter the muffles such as 5, 6, 7, 8 . . . at the mouth of the annealing furnace. For clearness' sake, the casing of the furnace is not shown and the heating resistor rods 10, 11, 12 are shown disposed on the vault of the furnace and perpendicular to the direction in which the blanks pass. Said disposition provides for a high degree of homogeneity in heatng between the troughs and also makes it possible to change a defective heating rod during operation.

Hydrogen intended to form a reducing atmosphere is brought into the tubes at the outlet of the annealing furnace by connections such as 15 only one of which is illustrated. The hydrogen flows against the direction of movement of the electric components due to the fact that the flow of water in the quenching apparatus prevents it flowing in the other direction. It leaves at the other end where it is burnt (flame 15A). Of course, if need be, it could be recovered and recycled.

Downstream from the annealing furnace, the muffles 5, 6, 7, 8 are connected to muffles 17, 18, 19, 20 of quenching apparatus 16 by connections 17A, 18A, 19A, 20A . . . . These quenching muffles are fed with cooling water by injectors at both ends, which injectors are schematically illustrated at 21 and 22 for the muffle 20. Injectors such as the one described and illustrated in French Pat. No. 2,227,332 are suitable for this purpose and will therefore not be described in detail. The cooling water flows in each muffle, towards its middle where the flows meet and is discharged via a pipe such as 23.

The apparatus operates as follows.

In the annealing furnace, the blanks are brought up to a temperature which ensures the recovery of their mechanical characteristics after cold drawing and consequent work hardening. The furnace is long enough for heating to propagate sufficiently from the sheath to the core of a blank via the mineral insulant.

When the blanks enter the quenching apparatus, the sheath cools down suddenly on coming into contact with water. In contrast, the core cools down more slowly. The length of the quenching apparatus is such that the core is also brought to a temperature close to ambient temperature at its outlet.

The blank is then ready either for a further stretching operation or to be delivered as it is.

The present invention also relates to annealing and quenching of tubes, rods or steel bars made of fine or special steel which, after annealing, require hyper-quenching to avoid the formation of spheroid sigma.

Although the method and the apparatus which have just been described in detail with reference to the FIGURE of the drawing appear to be the preferable embodiments of the invention, it will be understood that various modifications can be made thereto, it being possible in particular to replace some components of the apparatus by others which could perform an analogous technical function. More specially, heating in the annealing furnace could be provided by burners.

I claim:

1. Apparatus for sequentially annealing and quenching armoured electric components, said components including at least a conductor core, a coating of mineral insulant and an outer sheath of fine or special steel with an austenitic structure, said apparatus comprising:

unitary longitudinal mufflers bearing respectively said components, at least one annealing furnace along an upstream portion of said unitary muffles including means for containing a reducing or neutral atmosphere therein, and quenching means along a downstream portion of said unitary muffles including means for flowing a cooling fluid through each said downstream muffle portion in a circuit, the improvement further comprising means for controlling the inlet temperature and the flow rate of the cooling fluid flowing through each downstream muffle portion, so that the components undergo no trnasformation of their austenitic structure during quenching, and means for subjecting each electric component to direct contact with the cooling fluid during passage through said downstream portion of said muffles, and wherein said apparatus consists of a single furnace about said upstream muffle portion for simultaneously annealing said sheath and said core during passage through said upstream portion of each of said muffles, and wherein said single furnace includes resistors exterior of said muffles to effect a high degree of homogenity in heating and to insure simultaneous anneaing of the conductor core and said outer sheath.

2. The apparatus according to claim 1, wherein said longitudinal muffles extend parallel to each other, and wherein said resistors are disposed perpendicular to the direction in which the components pass through said longitudinal muffles and said resistors are parallel to one another.

3. The apparatus according to claim 1, wherein said resistors comprise silicon carbide rods.

* * * * *